US011753874B2

(12) United States Patent
Slaughter, Jr.

(10) Patent No.: US 11,753,874 B2
(45) **Date of Patent: *Sep. 12, 2023**

(54) INSERT FOR USE WITH DUAL-MEMBER PIPE JOINT

(71) Applicant: The Charles Machine Works, Inc., Perry, OK (US)

(72) Inventor: Greg L. Slaughter, Jr., Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 108 days.

This patent is subject to a terminal disclaimer.

(21) Appl. No.: 17/361,634

(22) Filed: Jun. 29, 2021

(65) Prior Publication Data

US 2021/0324684 A1 Oct. 21, 2021

Related U.S. Application Data

(63) Continuation of application No. 16/034,005, filed on Jul. 12, 2018, now Pat. No. 11,053,747.

(60) Provisional application No. 62/540,277, filed on Aug. 2, 2017.

(51) Int. Cl.

| | |
|---|---|
| ***E21B 17/04*** | (2006.01) |
| ***E21B 17/046*** | (2006.01) |
| ***E21B 7/04*** | (2006.01) |

(52) U.S. Cl.

CPC ..... *E21B 17/04* (2013.01); *E21B 7/046* (2013.01); *E21B 17/046* (2013.01)

(58) Field of Classification Search

CPC ..... E21B 17/04; E21B 17/046; E21B 7/046

See application file for complete search history.

(56) References Cited

U.S. PATENT DOCUMENTS

| | | | | |
|---|---|---|---|---|
| 3,637,239 | A | 1/1972 | Daniel | |
| 4,940,098 | A | 7/1990 | Moss | |
| RE38,418 | E | 2/2004 | Deken et al. | |
| 7,694,753 | B2 | 4/2010 | Carlson et al. | |
| 8,201,644 | B2 | 6/2012 | Hall et al. | |
| 9,765,574 | B2 | 9/2017 | Slaughter, Jr. et al. | |
| 9,803,433 | B2 | 10/2017 | Slaughter, Jr. et al. | |
| 2008/0078584 | A1 | 4/2008 | Lyon | |
| 2015/0233192 | A1* | 8/2015 | Slaughter, Jr ..... | E21B 7/20 175/320 |
| 2016/0245025 | A1 | 8/2016 | Slaughter, Jr. et al. | |
| 2018/0002990 | A1 | 1/2018 | Wilson et al. | |

* cited by examiner

*Primary Examiner* — Cathleen R Hutchins

(74) *Attorney, Agent, or Firm* — Tomlinson McKinstry, P.C.

(57) ABSTRACT

An insert for installation on an inner pipe member of a dual-pipe member assembly. The insert is interposed between an external shoulder formed on the inner pipe member and an internal shoulder formed in an outer pipe member. Shoulder-to-shoulder impacts between pipe members results in wear to the insert, rather than to either pipe member. The insert has the shape of an unclosed loop and is positioned within an endless external groove formed in the inner pipe member.

17 Claims, 8 Drawing Sheets

INSERT FOR USE WITH DUAL-MEMBER PIPE JOINT

SUMMARY

The present invention is directed to an assembly comprising a first pipe member and an insert having the shape of an unclosed loop at least partially surrounding the first pipe member. The assembly further comprises a second pipe member at least partially surrounding the first pipe member and the insert.

The present invention is also directed to an assembly comprising first pipe member having an endless external groove, and a second pipe member at least partially surrounding the first pipe member and having an internal shoulder. The assembly further comprises an insert situated within the endless external groove of the first pipe member that is configured to contact the internal shoulder of the second pipe member.

DETAILED DESCRIPTION

Figure 1:
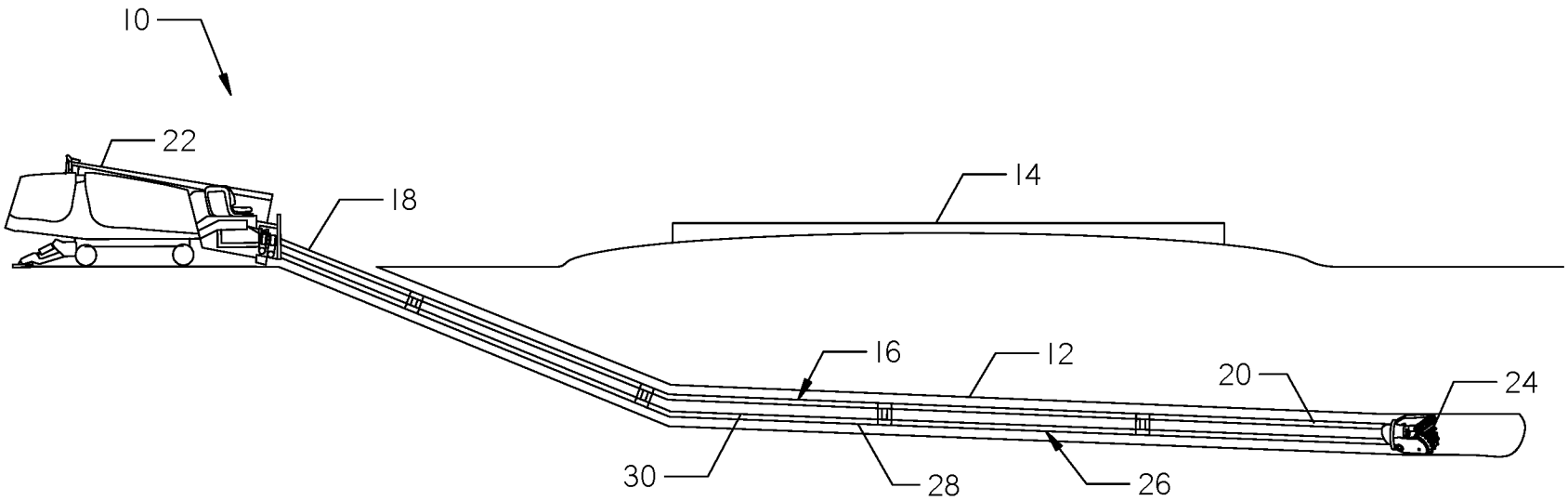
FIG. 1 is a diagrammatic representation of a horizontal directional drilling operation in which a dual-member drill string is used to drill a borehole.

With reference to FIG. 1, a horizontal directional drilling system 10 is shown. The system 10 is used to create a borehole 12 under an above-ground obstacle, such as roadway 14. The system 10 uses a dual-member drill string 16 having a first end 18 and a second end 20. The drill string 16 is attached to a drilling rig 22 at its first end 18 and a drill bit 24 at its second end 20. The drill string 16 transmits thrust and rotation force from the drilling rig 22 to the drill bit 24.

The dual-member drill string 16 is made-up of a plurality of pipe assemblies 26. The pipe assemblies 26 are arranged in end-to-end relationship such that a plurality of outer pipe members 28 form a torque-transmitting outer drive train, and a plurality of inner pipe members 30 form a torque-transmitting inner drive train. The inner pipe members 30 are disposed generally coaxially within the outer pipe members 28. The pipe members 28, 30 are typically made out of steel.

The drilling rig 22 comprises a drive system configured to drive independent rotation of the inner and outer drive trains. The drilling rig 22 and pipe assemblies 26 are configured such that the outer drive train is selectively rotatable to position a steering feature while the inner drive train rotates the drill bit 24. Thrust is imparted to the drill bit 24 through the outer drive train.

Figure 2:
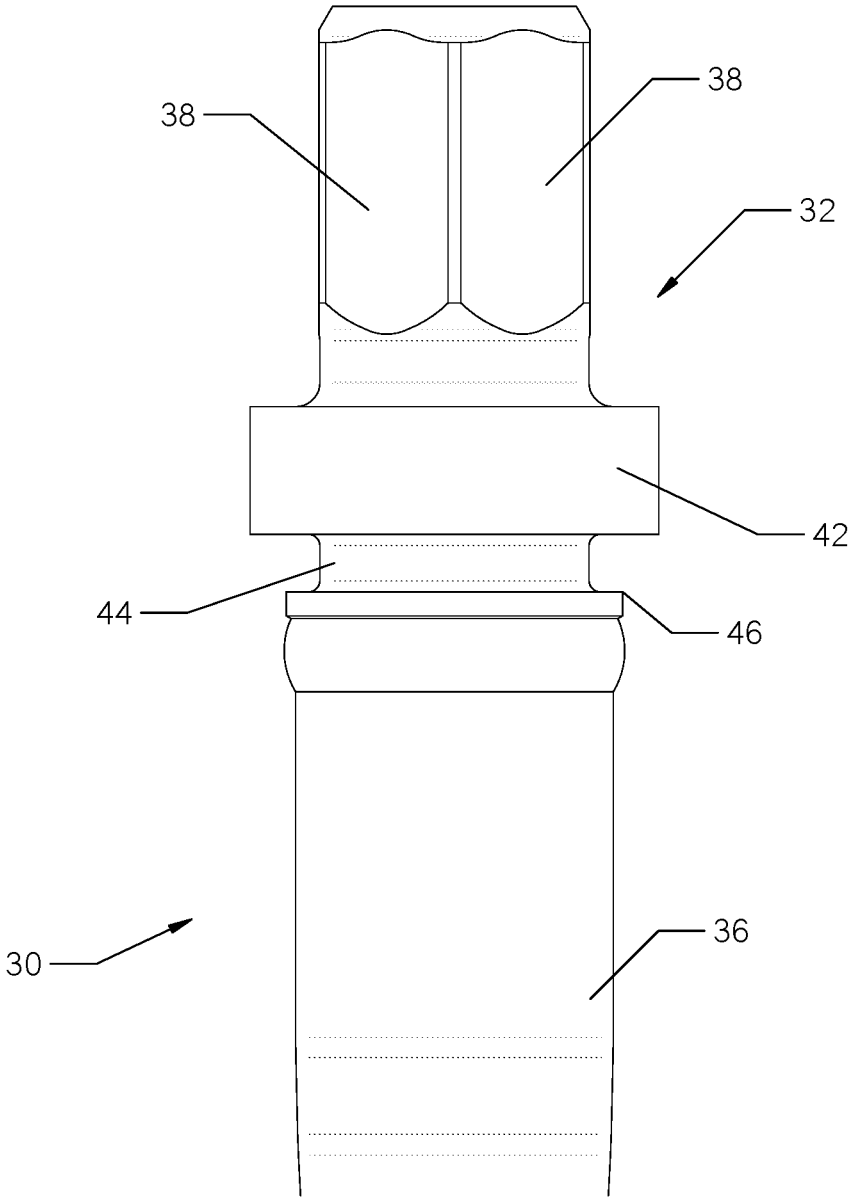
FIG. 2 a side elevational view of a pin end of a partial inner pipe member of the dual-member drill string.
Figure 3:
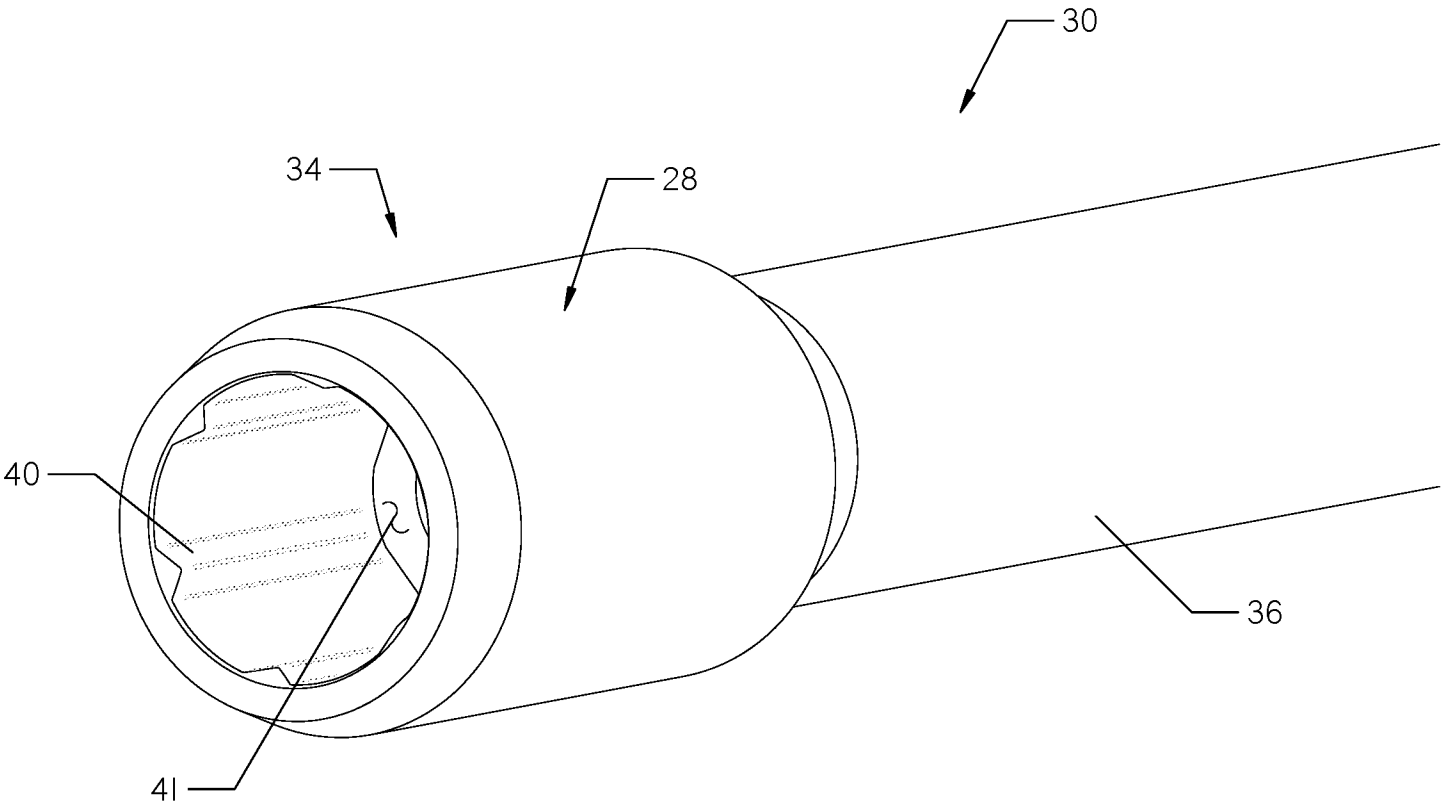
FIG. 3 is a perspective view of a box end of a partial inner pipe member of the dual-member drill string.

Turning to FIGS. 2-3, a view of each end of one of the inner pipe members 30 is shown. A pin end 32 is shown in FIG. 2 and a box end 34 is shown in FIG. 3. An elongate hollow body 36 joins the pin end 32 to the box end 34. The pin and box ends 32, 34 are normally welded to the elongate body 36. The pin end 32 is configured to mate with the box end 34 of an adjacent inner pipe member 30 in torque transmitting "slip-fit" or "connector-free" engagement.

Figure 7:
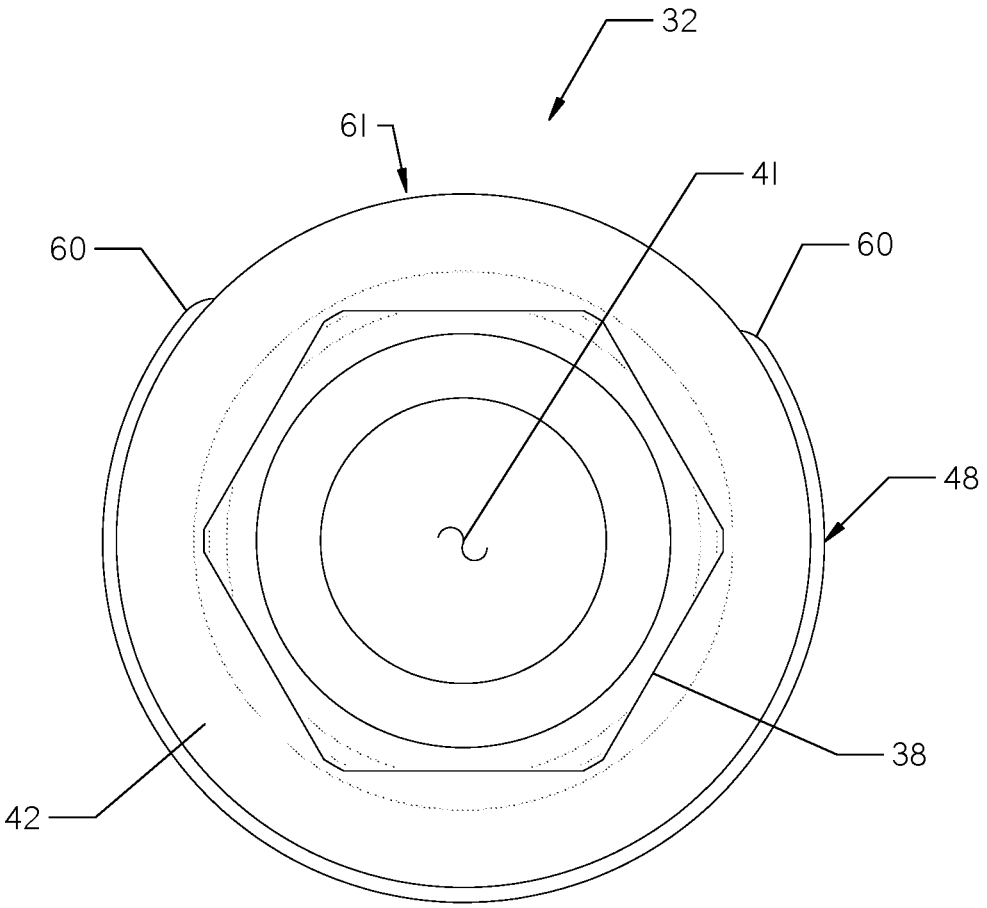
FIG. 7 is a top plan view of the inner pipe member and insert shown in FIG. 6.

The pin end 32 has a plurality of flat sides 38 that mate to form a polygonal cross-sectional shape. The box end 34 has a plurality of internal projections 40 formed in its interior walls. The internal projections 40 shown in FIG. 3 have a triangular cross-sectional shape. When the pin end 32 of an inner pipe member 30 is inserted into the box end 34 of an adjacent inner pipe member 30, the flat sides 38 engage with the internal projections 40. This engagement prevents relative rotation between the members 30 and allows torque to be transferred between the adjacent inner pipe members 30. A passage 41 may be formed in the pin and box ends 32, 34 that is in fluid communication with the hollow elongate body 36, as shown in FIGS. 3 and 7.

Continuing with FIG. 2, an annular external shoulder 42 is formed on the pin end 32 of the inner pipe member 30 adjacent the flat sides 38. The external shoulder 42 has a larger diameter than the mated flat sides 38 and the elongate body 36. An endless external groove 44 is formed in the pin end 32. The groove 44 is a recess formed in the outer surface of the inner pipe member 30 and has a U or V-shaped profile. The groove 44 is bounded on one side by the external shoulder 42 and on an opposite side by an end 46 of the elongate body 36. As discussed later herein, the groove 44 is configured to receive an insert 48, as shown in FIGS. 5-6.

Figure 4:
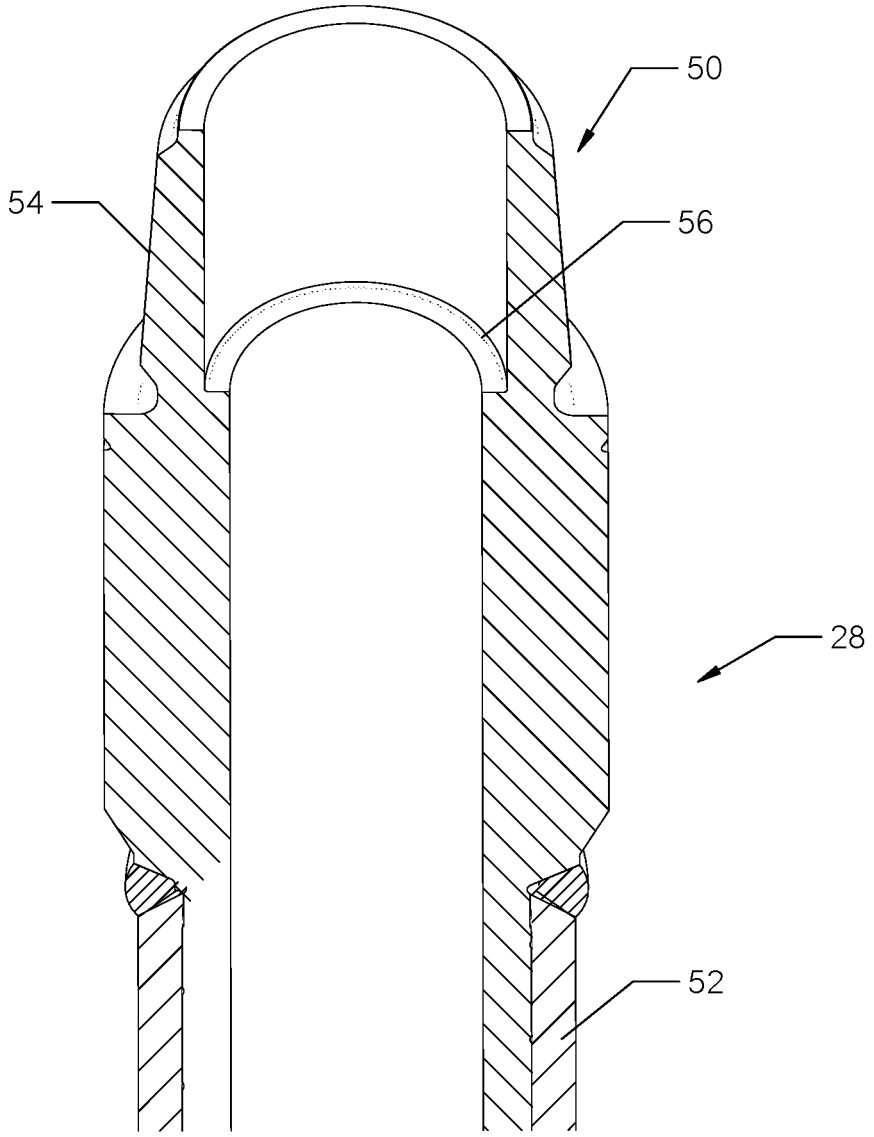
FIG. 4 is a cross-sectional view of a pin end of a partial outer pipe member of the dual-member drill string.

Turning to FIG. 4, a pin end 50 of an outer pipe member 28 is shown. The pin end 50 is joined to a box end (not shown) of the outer pipe member 28 via an elongate hollow body 52. The pin end 50 and box end of the outer pipe member 28 are normally welded to the elongate body 52. While not shown, the pin end 50 typically has a plurality of threads formed on its external surface 54 and the box end typically has a plurality of threads formed on its internal surface. The outer pipe members 28 are connected by threading the pin end 50 of an outer pipe member 28 into the box end of an adjacent outer pipe member. The pin end 50 and box end of the outer pipe members 28 are hollow and in fluid communication with the hollow elongate body 52.

Continuing with FIG. 4, an annular internal shoulder 56 is formed in the pin end 50 of the outer pipe member 28. In dual pipe member assemblies 26 known in the art, the external shoulder 42 of the inner pipe member 30 directly engages with the internal shoulder 56 of the outer pipe member 28. The direct contact between the shoulders 42, 56 limits the longitudinal movement of the inner pipe member 30 relative to the outer pipe member 28. However, over time, the repeated contact between the shoulders 42, 56 causes wear. The majority of the wear is typically seen on the external shoulder 42 of the inner pipe member 30.

Figure 5:
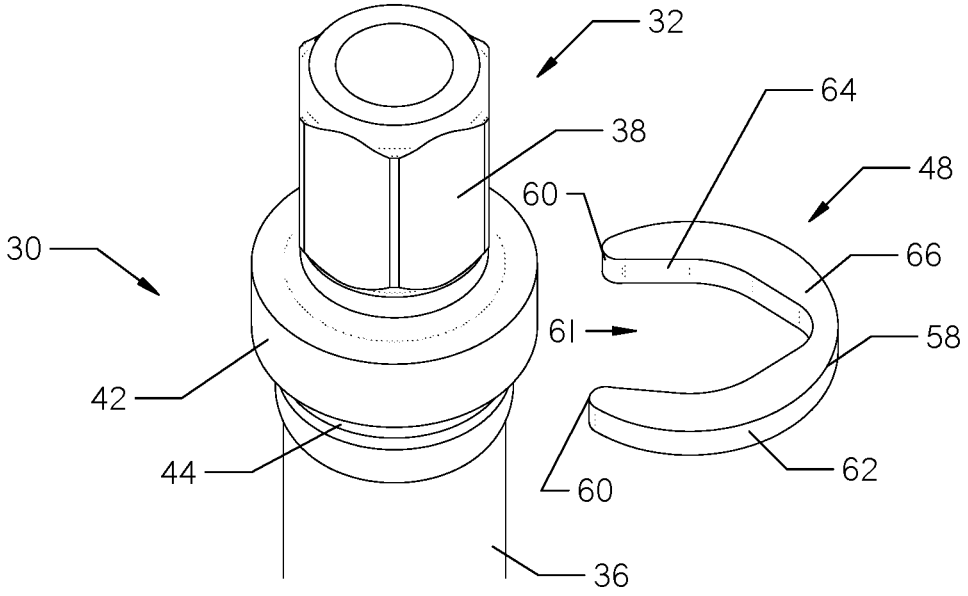
FIG. 5 is a perspective view of the pin end of the partial inner pipe member shown in FIG. 2. An insert configured for installation on the inner pipe member is shown adjacent the inner pipe member in FIG. 2.
Figure 6:
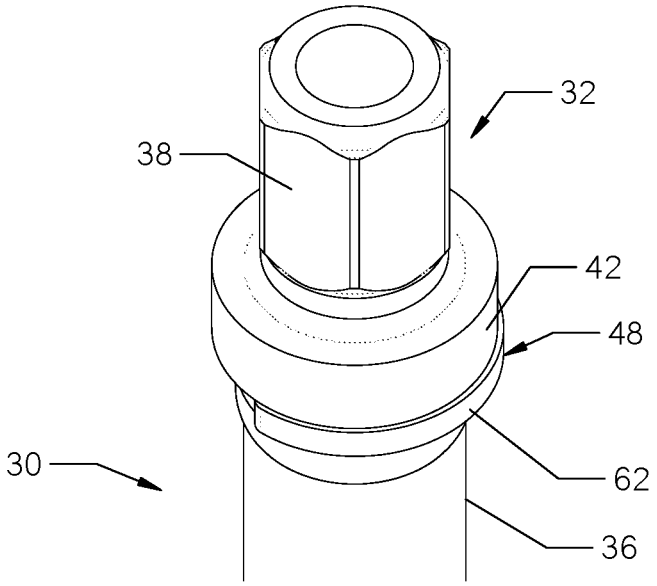
FIG. 6 is a perspective view of the pin end of the partial inner pipe member shown in FIG. 5 with the insert installed on the inner pipe member.

Turning to FIGS. 5-7, the insert 48 operates to prevent wear between the shoulders 42, 56 during drilling operations. The insert 48 is formed as a separate piece from the outer and inner pipe members 28 and 30. The insert 48 has the shape of an unclosed loop: it has an arched body 58 having opposed ends 60 that are separated by a gap 61. The insert 48 is further characterized by an outer surface 62, an inner surface 64, and a pair of side surfaces 66 extending between the outer and inner surfaces. Preferably, the side surfaces 66 are planar surfaces situated in parallel relationship.

The insert 48 is formed from a composite material having wear resistant properties, such as hardened steel. Preferably, the insert 48 is formed from a material having common pressure-velocity values higher than 35,000 psi-fpm.

The insert 48 is configured to fit within the groove 44 formed on the inner pipe member 30, as shown in FIG. 6. During assembly, the ends 60 of the insert 48 are positioned in the groove 44. Pressure is applied to the insert 48 to force it onto the inner pipe member 30. The insert 48 and the groove 44 are sized so that the insert 48 and inner pipe member 30 are fastened together by an interference fit. Once installed on the inner pipe member 30, the diameter of the insert 48 exceeds the diameter of the external shoulder 42, as shown in FIGS. 6 and 7. Thus, the maximum cross-sectional dimension of the insert 48 exceeds the depth of the groove 44.

In alternative embodiments, the insert 48 may be formed of two separate pieces joined together by a hinge (not shown). Such insert may be installed on the inner member 30 by rotating the hinge so that the pieces are spaced apart. Once installed on the inner member 30, the hinge may be rotated so that the pieces are moved closer together and tightly clamped around the inner member 30. In such embodiment, the opposed ends 60 may still be separated by a gap 61. Alternatively, the opposed ends 60 may not be separated by a gap 61 and may instead be releasably attached so as to form a closed loop. If the insert 48 is a closed loop, one or more bores may be formed through the insert to serve as fluid flow passages.

In another alternative embodiment, multiple thinner inserts 48 stacked on top of one another may be used in place of the single insert 48, shown in FIGS. 5-7. Using multiple inserts 48 provides multiple wear surfaces. Having multiple wear surfaces decreases the amount of dynamic friction imparted between the insert 48 and the shoulders 42, 56. Decreasing the amount of dynamic friction between the insert 48 and the shoulders 42, 56 increases the overall life and efficiency of the dual-member pipe joint. Having multiple wear surfaces also allows only the worn surfaces to be replaced, as needed, instead of replacing the entire insert 48.

Figure 8:
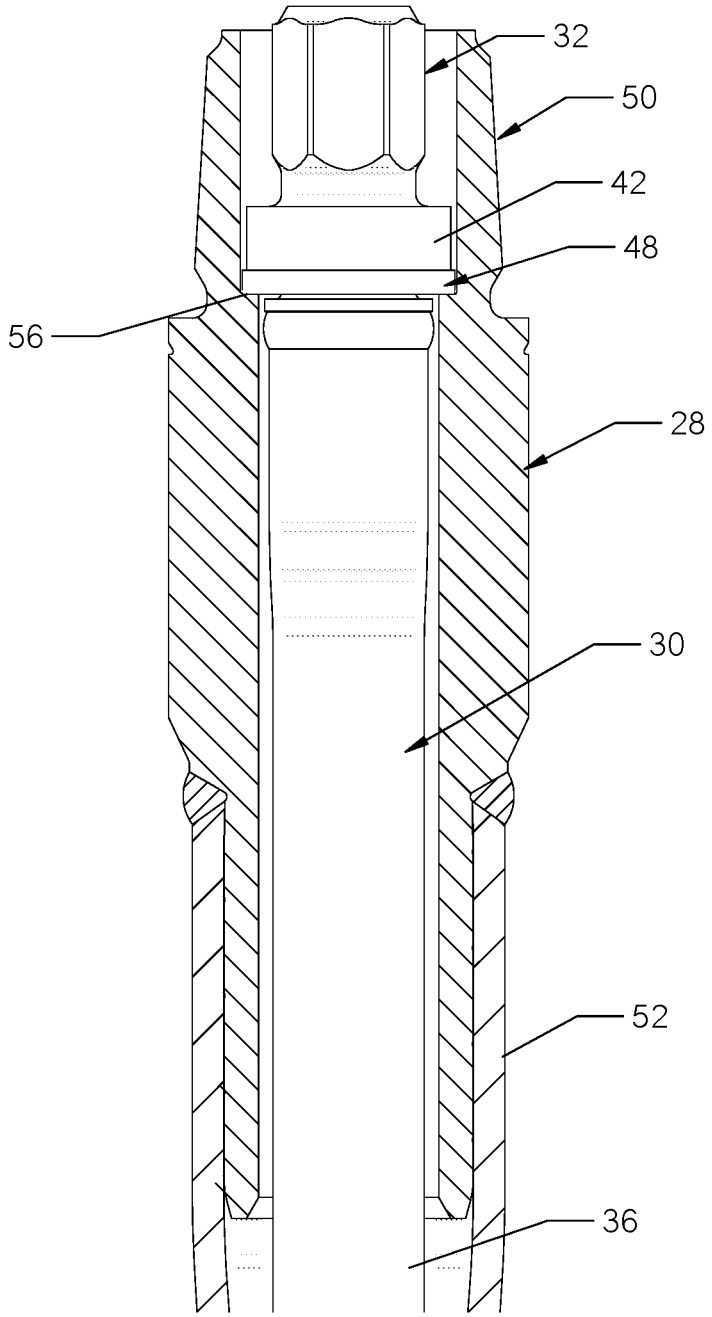
FIG. 8 is a side elevational view of a partial inner pipe member and insert installed within a partial outer pipe member. A portion of the outer pipe member has been cut away for better display.
Figure 9:
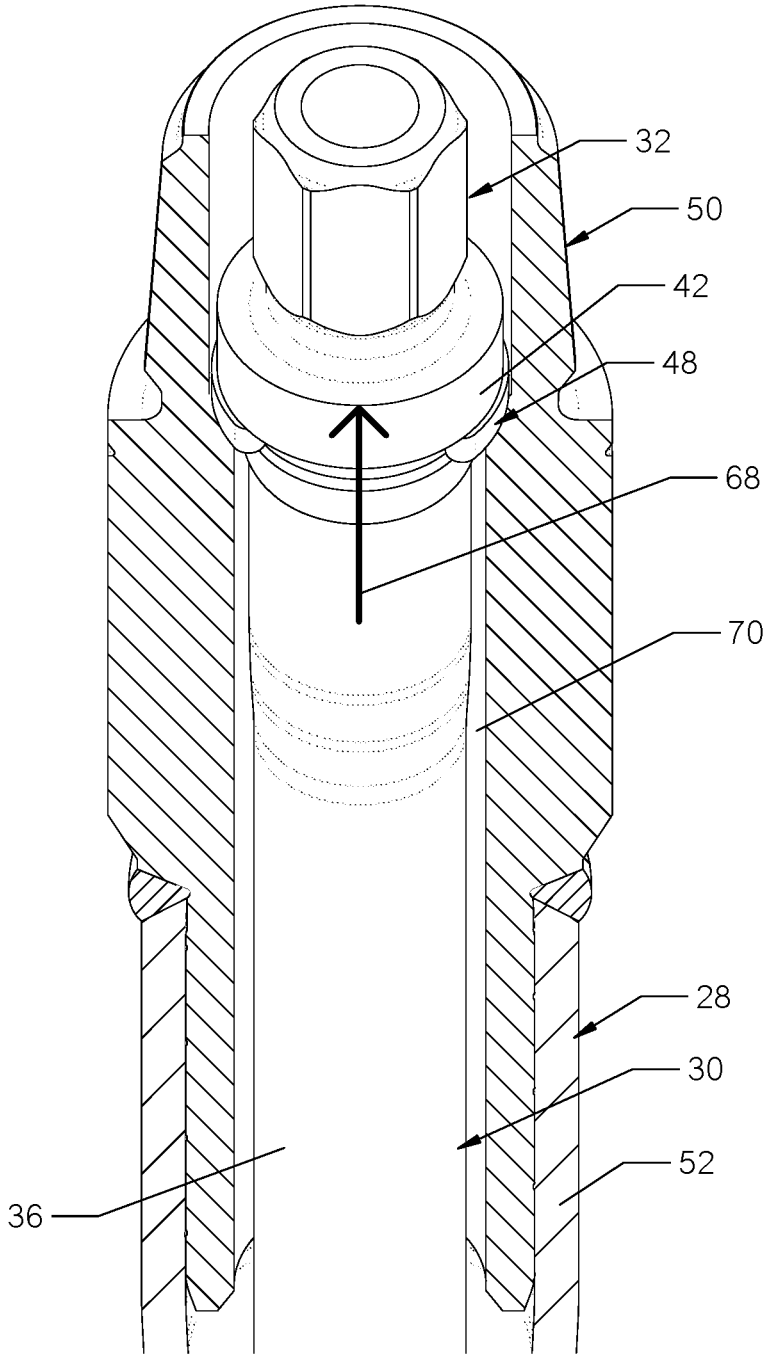
FIG. 9 a perspective view of the partial inner and outer member shown in FIG. 8. A portion of the outer member has been cut away for better display.

Turning to FIGS. 8-9, the inner pipe member 30 and insert 48 are shown installed within the outer pipe member 28. The insert 48 contacts the internal shoulder 56 of the outer pipe member 28 instead of the external shoulder 42. This positioning allows any wear between the members 28, 30 over time to be imparted on the insert 48 rather than the external shoulder 42. If the insert 48 has worn to a point where it is no longer usable, it can easily be replaced with a new insert 48.

Continuing with FIG. 8, the diameter of the external shoulder 42 of the inner pipe member 30 exceeds the inner diameter of the internal shoulder 56 formed in the outer pipe member 28. Such configuration reinforces the insert 48 so that it is not subjected to overhung loads which may cause the insert 48 to deflect or physically deform. Deformation of the insert 48 may cause the inner pipe member 30 to bind.

Turning to FIGS. 7 and 9, the gap 61 between the ends 60 of the insert 48 provides a passage or flow path within the assembled dual-member drill string 16, as shown by arrow 68 in FIG. 9. The flow path 68 is contiguous with a passage 70 formed between the inner and outer pipe members 28, 30, as shown in FIGS. 1 and 9. The flow path 68 assures that the insert 48 will not block flow through the passage 70.

Changes may be made in the construction, operation and arrangement of the various parts, elements, steps and procedures described herein without departing from the spirit and scope of the invention as described in the following claims.

The invention claimed is:

1. An apparatus, comprising:

an insert configured for use with a pipe assembly, the pipe assembly comprising:

a first inner pipe member configured to be coupled to a second inner pipe member such that the first and second inner pipe members are in a torque-transmitting relationship;

a first outer pipe member at least partially surrounding the first inner pipe member, in which the first outer pipe member is configured to be coupled to a second outer pipe member such that the first and second outer pipe members are in a torque-transmitting relationship; and a fluid passage extending between an outer surface of the first inner pipe member and an inner surface of the first outer pipe member:

in which the insert has the shape of an unclosed loop and has opposed ends separated by a gap; and in which the insert is configured to at least partially surround the outer surface of the first inner pipe member such that at least a portion of the insert is situated within the fluid passage and the fluid passage extends through the gap.

2. The apparatus of claim 1, in which the insert has an arched body formed between the opposed ends.

3. The apparatus of claim 1, in which the opposed ends of the insert are separated by the gap when the insert is in an unstressed state.

4. The apparatus of claim 1, in which the insert is configured to be rigidly secured to the first inner pipe member; and in which the first inner pipe member is configured to rotate independently of the first outer pipe member.

5. The apparatus of claim 1, in which the first inner pipe member is configured to rotate independently of the first outer pipe member.

6. The apparatus of claim 1, in which the insert is configured to be positioned within a groove formed in the outer surface of the first inner pipe member.

7. An assembly, comprising:

a first pipe member;

an insert having the shape of an unclosed loop at least partially surrounding the first pipe member, in which the insert has opposed ends separated by a gap; and a second pipe member at least partially surrounding the first pipe member and the insert;

in which the first pipe member is rotatable independently of the second pipe member;

in which a groove is formed in an outer surface of the first pipe member, and the insert is situated within the groove; and in which the second pipe member has an internal shoulder, and the insert is supported by the internal shoulder when situated within the groove.

8. The assembly of claim 7, in which the groove is bounded on one side by an external shoulder formed in the first pipe member.

9. The assembly of claim 8, in which the insert has a maximum cross-sectional dimension that exceeds the depth of the groove.

10. The assembly of claim 7, in which the second pipe member has opposed ends, and in which a fluid path is formed between the first and second pipe members and extends from end-to-end of the second pipe member and traverses the insert.

11. The assembly of claim 8, in which the insert has an arched body formed between the opposed ends.

12. The assembly of claim 7, in which the insert is rigidly secured to the first pipe member such that the first pipe member and the insert are rotatable independently of the second pipe member.

13. A method of assembling an apparatus comprising an inner pipe member, an outer pipe member having opposed ends, and an insert having the shape of an unclosed loop and having opposed ends separated by a gap, the method comprising:

positioning the insert on the inner pipe member such that the insert at least partially surrounds an outer surface of the inner pipe member; and installing the inner pipe member within the outer pipe member such that the outer pipe member at least partially surrounds the inner pipe member and a fluid passage is formed between the outer surface of the inner pipe member and an inner surface of the outer pipe member, and such that at least a portion of the insert is situated within the fluid passage and the insert the fluid passage extends through the gap.

14. The method of claim 13, in which the step of positioning the insert on the inner pipe member comprises:

positioning the insert within a groove formed in the outer surface of the inner pipe member.

15. The method of claim 13, in which the inner pipe member has opposed ends, and in which the inner pipe member is installed within the outer pipe member such that the opposed ends of the outer pipe member at least partially surround the opposed ends of the inner pipe member.

16. The method of claim 13, in which the step of positioning the insert on the inner pipe member comprises:

rigidly securing the insert to the inner pipe member.

17. The method of claim 13, in which the inner pipe member is installed within the outer pipe member such that the inner pipe member is rotatable independently of the outer pipe member.

* * * * *